United States Patent [19]

Yokoi

[11] 4,306,329

[45] Dec. 22, 1981

[54] SELF-PROPELLED CLEANING DEVICE WITH WIRELESS REMOTE-CONTROL

[75] Inventor: Gunpei Yokoi, Kyoto, Japan

[73] Assignee: Nintendo Co., Ltd., Kyoto, Japan

[21] Appl. No.: 82,412

[22] Filed: Oct. 5, 1979

[30] Foreign Application Priority Data

Dec. 31, 1978 [JP] Japan ..... 53-182455[U]
Dec. 31, 1978 [JP] Japan ..... 53-182456[U]
Apr. 6, 1979 [JP] Japan ..... 54-46187[U]

[51] Int. Cl.[3] ..... A47L 9/28

[52] U.S. Cl. ..... 15/319; 15/339; 15/340; 15/412; 180/6.5; 180/79; 180/167; 340/825.69

[58] Field of Search ..... 15/319, 339, 340, 412; 325/37; 180/6.5, 79, 167

[56] References Cited

U.S. PATENT DOCUMENTS 1,935,158 11/1933 Lumley ..... 15/319
2,923,954 2/1960 Babcock ..... 15/319 X
3,010,129 11/1961 Moore ..... 15/319 X
3,303,821 2/1967 Harris ..... 119/29
3,626,545 12/1971 Sparrow ..... 15/339 X
3,713,505 1/1973 Muller ..... 15/319 X
3,789,939 2/1974 Geislinger ..... 15/319 X
3,837,028 9/1974 Bridge ..... 15/50 R
4,114,711 9/1978 Wilkins ..... 15/319 X
4,173,809 11/1979 Ku ..... 15/319

OTHER PUBLICATIONS

*The Washington Post and Times Herald,* Feb. 10, 1959, p. B8; "Kitchen of Tomorrow to Visit Ussr".

*Primary Examiner*—Christopher K. Moore
*Attorney, Agent, or Firm*—Bierman & Bierman

[57] ABSTRACT

A self-propelled cleaning device with wireless remote control includes a body, a driving device on the body for moving the same rotatably about its axis or in a straight line along the underlying ground surface, and a vacuum cleaning device carried on the body with its suction port open to the underside thereof. The cleaning device normally rotates on its axis at a stationary or fixed location on the underlying surface for concentrated spot cleaning of the underlying surface. The wireless remote control is effective to change the operative mode of the cleaning device from stationary rotation to straight-line travel.

10 Claims, 19 Drawing Figures

SELF-PROPELLED CLEANING DEVICE WITH WIRELESS REMOTE-CONTROL

BACKGROUND OF THE INVENTION

1. Field of the Invention

The present invention relates to a self-propelled cleaning device with wireless remote control, and, more particularly, to a vacuum cleaner which includes a self-contained power source for driving the device on an underlying support surface and for operating a self-contained vacuum cleaning mechanism whereby operation of the cleaning device may be remotely controlled by a wireless system.

2. Prior Art

In conventional self-propelled vacuum cleaners, power for operating the same is drawn through a trailing electric cord connected with the building's central electrical lines. Unless these devices are used for cleaning wide, open or otherwise well-defined areas such as floors or corridors, the trailing electric cord tends to become snagged or otherwise caught under or around upstanding objects on the surface. As a consequence, conventional units of this type require close supervision and are not generally suitable for vacuum cleaning operations in homes.

Vacuum-type cleaners which include a self-contained battery as a power source for the vacuum cleaning means are known for small-scale manual uses in which the device is moved by the user over a small area such as the surface of a desk or table. These devices are not generally suitable for cleaning the floor surface of rooms and, in any event, would have to be manually moved to and manipulated about the location at which cleaning is desired.

SUMMARY OF THE INVENTION

It is therefore an object of the present invention to provide a self-propelled vacuum cleaner with wireless remote control which enables a user to perform vacuum cleaning work from a remote location, dispenses with the trailing electric source cord which might otherwise become entangled with objects and fixtures in the room being cleaned, and enables changes in the direction of movement of the device by axial rotation of the device for concentrated spot cleaning of a selected floor surface position.

It is another object of the present invention to provide a self-propelled vacuum cleaning device which enables cleaning work to be performed in close proximity to a vertical wall surface or to other objects which present obstacles to the continued movement of the device.

It is a further object of the present invention to provide a simplified switch mechanism for starting and stopping movement of the device and a control mechanism for changing the operative mode of the cleaning device from straight-line motion to axial rotation.

The present invention accordingly provides a self-propelled vacuum cleaner including a wireless remote control and comprising a cleaner body, driving means for moving the body through axial rotation and straight line motion, and means for cleaning therebetween by wireless remote control. Vacuum cleaning means with a downwardly-open suction port is mounted on the body. The vacuum cleaner device may be caused to travel in a straight line or to axially rotate while stationary for concentrated cleaning. Modal change therebetween is initiated by wireless remote control.

The present invention further provides a dome-like body mounted on a base and enclosing vacuum cleaning and driving means. Thus, the vacuum cleaner has the ability to move close to vertical walls and furniture legs which would otherwise constitute obstacles to effective cleaning.

The present invention additionally provides a vacuum cleaner wherein the propulsion or moving means comprises a pair of substantially parallel traveling wheels, a reversible motor, a battery, and an electronic control circuit for reversing the rotative direction of the motor upon receipt of an electrical control signal. The invention also includes linkage for driving the traveling wheels from the motor such that, during normal rotation of the motor, the traveling wheels are rotated in relatively opposite directions, for stationary axial rotation of the cleaner. Reversal of the direction of rotation of the motor causes the traveling wheels to rotate in the same direction for substantially straight-line movement. The electric motor is caused to rotate in its normal direction in the absence of an electrical control signal and to rotate in a reverse direction on receipt of such signal.

Additional objects, features, and advantages of the present invention will be more fully realized by reference to the following detailed description of a presently preferred, but nonetheless illustrative, embodiment in accordance with the invention, wherein.

DETAILED DESCRIPTION OF THE PREFERRED EMBODIMENT

Figure 1:
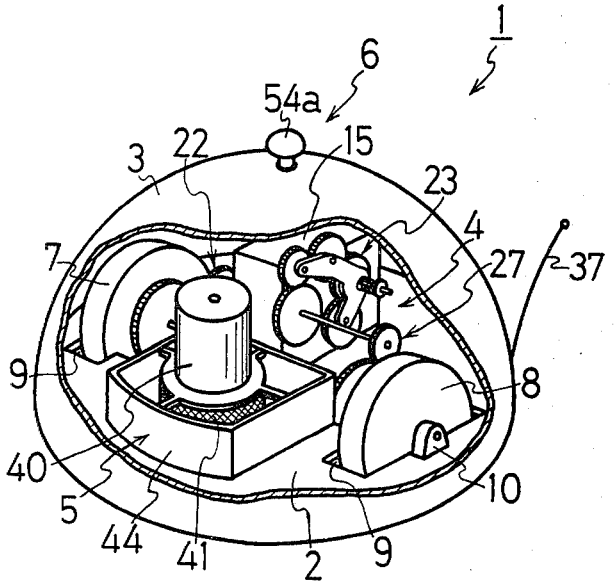
FIG. 1 is a perspective view, partially broken away, of a self-propelled vacuum cleaner constructed in accordance with the present invention.
Figure 2:
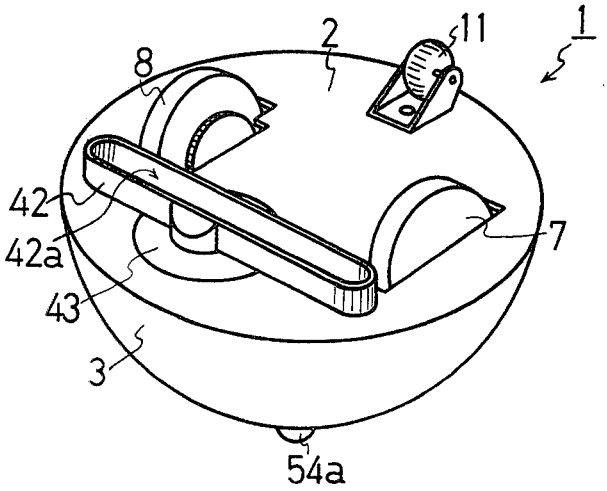
FIG. 2 is a perspective view of a vacuum cleaner according to the invention turned upside down.
Figure 3:
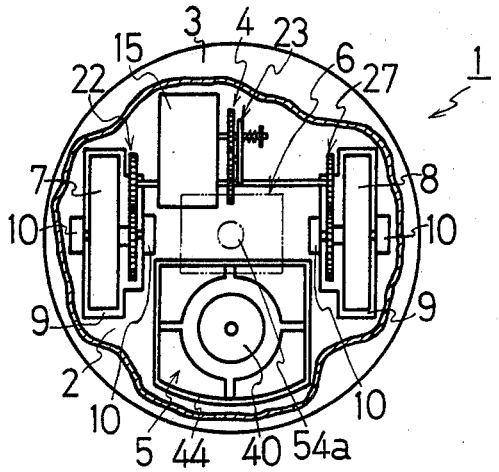
FIG. 3 is a plan view, partially broken away, of a vacuum cleaner according to the invention.
Figure 4:
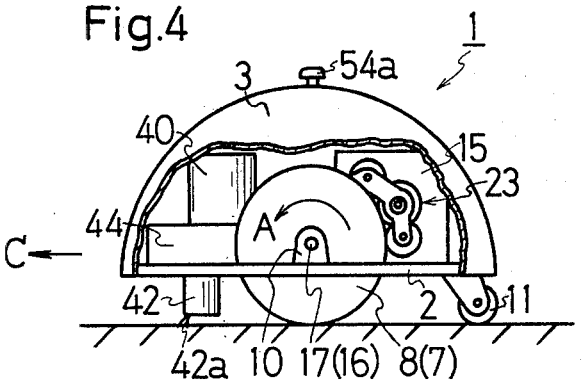
FIG. 4 is a side view, partially broken away, of a vacuum cleaner according to the invention.

Turning now to the drawings, there is illustrated in FIGS. 1 and 2 an embodiment of a self-propelled, remote-controlled cleaning device designated by the general reference numeral 1 and constructed in accordance with the present invention. The cleaning device 1 comprises a cleaner body formed of a substantially disc-shaped base 2 and a dome-like cover 3. More particularly, the base 2 supports a driving or propulsion means 4 for causing the body to travel in a straight line or to turn on its axis, and a vacuum cleaning means 5. An operating switch means 6 for initiating and terminating operation of at least the driving means 4 of the cleaner 1 projects upwardly through the dome 3 from the interior body chamber. As shown and described, the switch means 6 also controls operation of the vacuum cleaning means 5.

The driving means 4 includes a spaced-apart pair of drive wheels 7, 8 positioned at diametrically opposed locations on the base 2. The wheels 7,8 are rotatably supported on axle blocks 10 so that a radial portion of each wheel projects downwardly from the base 2 through an elongated aperature or window 9 defined therein. A free-wheeling caster 11 is secured proximate the edge of the underside of the base 2 at a peripheral location intermediate the positions of the wheels 7, 8 and is oriented for rotation in a plane substantially parallel to the plane of rotation of the wheels. The location of the caster 11 defines the rear or back of the cleaning device 1, as will soon be understood, and delineates the front of the device 1 at the diametrically opposite portion of the base 2. The drive wheels 7, 8 and caster 11 together support the base 2 in spaced relation above and substantially parallel to the underlying ground or floor surface with which the wheels make contact and along which the cleaning device 1 travels so that the cleaner 1 is maintained in a well-balanced and substantially level state.

A drive shaft 12 oriented parallel to the rotative axis of the wheels 7, 8 is rotationally driven by a reduction gear-equipped reversible motor 13 and projects from opposite sides of a drive casing 15. The casing 15 houses the motor 13 as well as an electronic control circuit 14 for controlling the motor and is carried within the cleaner body on the base 2. An axle shaft 16, which is axially connected for rotation with the wheel 7, is linked with the drive shaft 12 through a power transmitting system comprising a plurality of gears 18, 19, 20 and 21 such that the shaft 16 and connected drive wheel 7 are always rotated in a direction opposite the rotational direction of the motor-propelled drive shaft 12. A corresponding axle shaft 17 axially connected for rotation with the wheel 8 is linked with the drive shaft 12 through a reversing clutch mechanism generally designated 23 and a power transmitting system 27 comprising gears 24, 25 and 26. The shaft 17 is rotationally driven through the reversing clutch mechanism 23 and power transmitting system 27 in the rotational direction which corresponds to "normal" rotation of the drive shaft 12 and which is indicated by the reference arrow designated "A" in FIGS. 7 and 8. In other words, the shaft 17 and drive wheel 8 are always driven, irrespective of the actual rotative orientation or direction of the drive shaft 12, in the direction indicated by the arrow "A."

Figure 7:
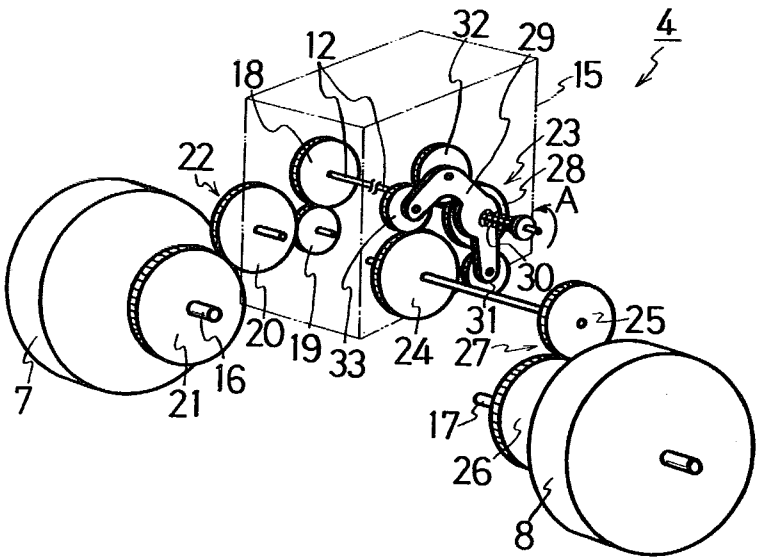
FIG. 7 is perspective view of the driving means of the vacuum cleaner.
Figure 8:
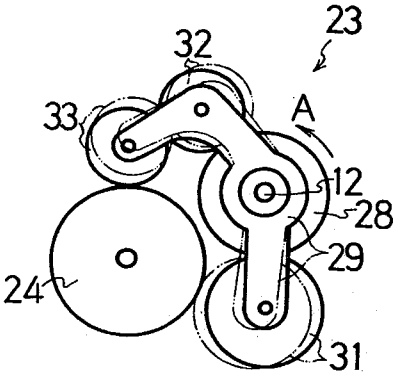
FIG. 8 illustrates the operative modes of the driving means of FIG. 7.
Figure 10:
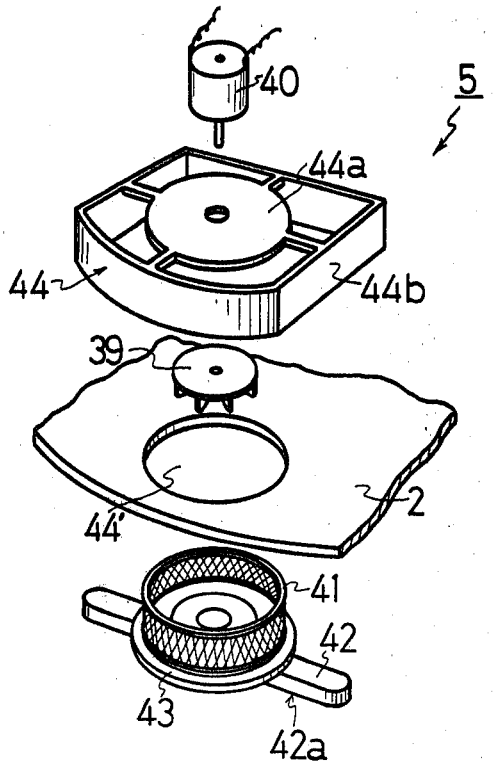
FIG. 10 is an exploded view of the vacuum cleaning means of the invention.

As is most clearly seen in FIGS. 7 and 8 the reversing clutch mechanism 23 includes a drive gear 28 rotatably fixed to the drive shaft 12 and a curved clutch plate 29 journaled at its central portion on the drive shaft 12 and independently rotatably relative thereto. A compression spring 30 disposed about the shaft 12 urges the clutch plate 29 into contact with one face of the drive gear 28. A reversing gear 31 is axially supported for rotation at one end of the clutch plate 29 for peripherally driven engagement with the drive gear 28 and is engageable with the gear 24 of the power transmitting system 27. The opposite end of the clutch plate 29 axially supports a rotatable normal gear 33 engageable with the gear 24. An intermediate gear 32 is similarly axially supported on the clutch plate 29 between the drive gear 28 and normal gear 33 such that the intermediate gear 32 is maintained in peripheral engagement with and between the gears 28, 33. In this manner, the normal gear 33 is rotationally driven by the drive gear 28 through the intermediate gear 32.

In operation of the aforedescribed arrangement of the reversing clutch mechanism 23, when the drive shaft 12 is rotated in its "normal" or "A" direction, the clutch plate 29 which is urged by the spring 30 into frictional contact with the drive gear 28, is displaced and rotated in the "A" direction. This displacement causes the normal gear 33 to peripherally engage the gear 24 in the manner shown in solid lines in FIG. 8. As a consequence, rotational drive power is transmitted from the drive shaft 12 to the axle shaft 17 through the series of interengaged gears 28, 32, 33, 24, 25 and 26. The drive wheel 8 is accordingly rotated in the "normal" rotational direction of the drive shaft 12—i.e. the direction indicated by the arrow A.

When the drive shaft 12 is turned in its reverse rotational direction, on the other hand, the clutch plate 29 is displaced and rotated in said reverse direction. In this reverse displacement of the clutch plate, the normal gear 33 is separated from peripheral engagement with the gear 24 and the reversing gear 31 is moved into peripheral engagement with the gear 24. This is depicted in broken lines in FIG. 8. During this reverse operational mode, power is transmitted from the drive shaft 12 to the axle shaft 17 through the interengaged gears 28, 31, 24, 25 and 26 and the wheel 8 is again rotated in the normal or "A" direction. In other words, the wheel 8 is always rotated in this direction irrespective of the actual rotative direction of the drive shaft 12.

Figure 9:
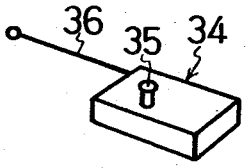
FIG. 9 is a perspective view of a wireless control transmitter for use with the inventive vacuum cleaner.

As hereinbefore mentioned, the drive shaft 12 is rotationally driven, through reduction gearing, by a reversible motor 13 enclosed within the drive casing 15. "Normal" and "reverse" operations of the motor 13, and corresponding rotations of the drive shaft 12, are wirelessly remote-controlled by a one-channel transmitter 34 illustrated in FIG. 9, in conjunction with the electronic circuit 14. More particularly, the motor 13 is usually operated to rotate the drive shaft 12 in its normal direction. When a spring-loaded push-button switch 35 of the transmitter 34 is depressed, a radio control signal is transmitted from an antenna 36. When the signal is received by a receiving antenna 37 on the cleaning device 1, the electronic circuit 14 causes the motor 13 to change its direction so as to rotate the drive shaft 12 in the reverse rotational direction. Thus, so long as the button switch 35 is depressed, the drive shaft 12 will be rotated in the reverse direction; when the switch 35 is released transmission of a radio control wave ceases and rotation of the shaft 12 returns to normal. A battery 38 disposed within the housing of the cleaning device 1 serves as an internal power source for the motor 13 and for the electronic control circuit 14.

The wireless remote control mechanism, including the transmitter 34 and electronic control circuit 14, are well known in the art and hence no details thereof are specifically provided. However, it will be recognized by those skilled in the art that the circuit 14 could be arranged to reverse the operational mode of the motor 13 on receipt of a signal from the transmitter 34 and to latch to or maintain the changed operational mode even after the switch 35 is released and until another control signal is transmitted. Such details and modifications are deemed to be purely a matter of design choice and are not intended to constitute a limitation on the scope of the invention herein disclosed.

Figure 5:
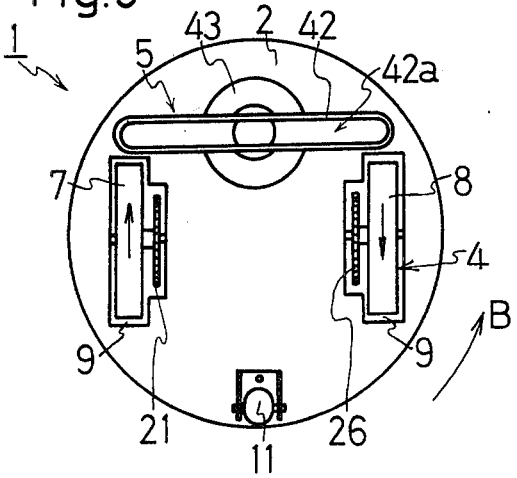
FIG. 5 is a bottom plan view illustrating rotation of the traveling wheels effective for axial rotation of the inventive vacuum cleaner.

Thus, in the disclosed embodiment of the cleaning device 1, the absence of a radio signal from the transmitter 34 causes the motor 13 to rotate the drive shaft 12 in its normal or "A"-designated direction, seen as counterclockwise in FIGS. 7 and 8. Normal rotation of the drive shaft 12 in turn effects rotation of the drive wheels 7, 8 whereby each wheel turns oppositely relative to the other. As a consequence, the cleaning device 1 is caused to turn on its vertical axis in the direction indicated by the reference arrow "B" in FIG. 5, and at a fixed position on the underlying floor surface.

Figure 6:
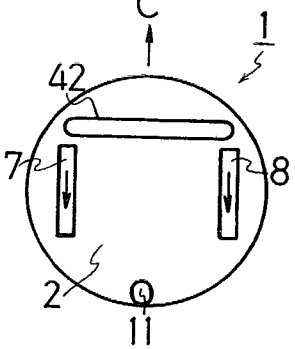
FIG. 6 is a simplified bottom plan view illustrating rotation of the traveling wheels effective to impart straight-line movement of the inventive vacuum cleaner.

Conversely, on receipt of a radio control wave from the transmitter 34, the electronic circuit 14 causes the drive shaft 12 to turn in its reverse direction, whereupon the drive wheels 7, 8 are together rotated in the same direction. The cleaning device 1 accordingly travels forward along the floor surface in a substantially straight line, as indicated by the reference arrow C in FIG. 6. This straight-line motion continues so long as the device 1 receives and detects a radio control signal or wave from the transmitter 34.

The vacuum means 5 is supported on the base 2 at the forward or leading portion of the cleaning device 1. As best seen in FIGS. 1, 2, 10 and 11, the means 5 includes a suction motor 40 equipped with an intake fan 39, preferably of the sirocco type, for drawing dust and the like into the device 1 from the floor or ground surface. A filter 41 of generally cylindrical shape for catching and retaining the dust circumferentially surrounds the intake fan 39. A suction case 42 extending axially between the opposed wheels 7, 8 defines a suction port **42*a*** leading to the interior of the cleaner body.

Figure 11:
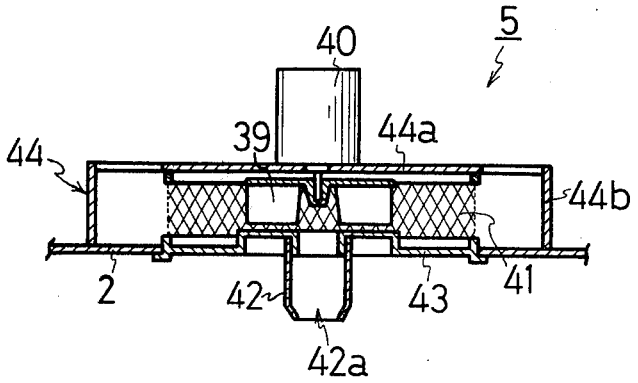
FIG. 11 is a side view, in longitudinal section, of the vacuum cleaning means of FIG. 10.

The suction case 42 is seen in FIG. 11 to be open only at its lower end, as delineated by the port **42*a*, and accordingly functions to draw dust and dirt into the filter 41 only as the cleaning device 1 passes directly thereover. It will, however, be recognized and appreciated that the suction case 42 and port 42*a* may assume any of a variety of shapes utilized in the design of conventional vacuum cleaners. Thus, by way of example only, the suction port 42*a* might open both downwardly and forwardly by appropriately angling the suction case 42 or by modifying the configuration of the case 42 or entry port 42*a***.

The filter 41 is supported atop an annular plate 43 engageable with the suction case 42. The filter 41 and the case 42 are fitted from the underside of the base 2 through a substantially round opening 44' defined in the base. The filter and base are sized to conform to a periphery of the plate 43 so as to enable detachable cleaning and replacement of the filter 41 when the same has become saturated with dust or dirt and the like.

A vacuum casing 44 is fixed on the upper portion of the base 2. The casing is provided with an upper wall portion **44*a* for overlaying the upper surface of the filter 41 and with a circumferential wall 44*b* for peripherally surrounding and enclosing the filter 41. The suction motor 40 is positioned and supported atop the upper wall 44*a* of the vacuum casing 44 so that the motor shaft projects through the portion 44*a* to dispose the intake fan 39 within the annular bounds of the encircling filter 41**.

The battery 38 which powers the motor 13 and electronic control circuit 14 may also be used to drive the suction motor 40. When so driven to turn the intake fan 39, dust and the like present on the underlying floor surface are drawn through the suction port **42*a* by the action of the fan 39 and deposited in the internally disposed filter 41. Dust so collected is easily disposed of by removing the filter supporting plate 43 and suction case 42 from the base opening 44'. The filter 41** may then either be emptied of the collected dust and returned to the housing or replaced with a new filter as desired.

Reference is now made to FIGS. 12 through 19 detailing the structural arrangement of the operating switch means 6, which will now be described. The switch means 6 is utilized for manually initiating and terminating a supply of operating power from the battery 38 to the driving means 4 and vacuum cleaning means 5.

An elongated guide tube 45 having a centrally defined, longitudinally disposed bore 32 and a recess at the lower end of the tube is vertically fixed to the interior of the dome 3 above the central portion of the base 2. The guide tube recess includes end portions **45*a*, 45*b* bounding the recess and radially connecting or bridging the bore 3*a* and the outer periphery of the tube 45. A plurality of support posts 53 fixedly suspend a switch table 52 from the dome 3 so that the table is located directly below and spaced from the lower termination of the tube 45. The switch table 52** carries on its upper surface or face a plurality of electrically conductive printed circuit contacts conventionally disposed thereon.

Specifically, a printed common contact 47 on the table 52 is electrically connected by a wire 46 to one of the terminals of the battery 38. A printed drive contact 49 on the table 52 is electrically connected by way of a wire 48 through the series connected motor control circuit 14 to the other of the battery terminals. And a printed suction contact 51 on the table 52 is electrically connected through a wire 50 to said other terminal of the battery 38. Thus, the switch table 52 carries three printed circuit contacts 47, 49, 51 which serve as switch contacts through which power is supplied to the driving means 4 and the vacuum means 5 upon operation of the switch means 6.

A generally elongated switch-operating member 54 is supported for axial rotation and vertically reciprocating movement along the central vertical axis of the cleaning device 1. More particularly, the operating member 54 comprises an integral structure which includes a shaft portion **54*b* equally movable in the guide tube bore 3*a*. The shaft portion carries, at its upper end, an actuating button 54*a* which is exterior of the dome 3 and accessible from the outside. A protrusion 54*c* radially extends from the shaft portion 54B and is disposed within the guide tube recess for engagement against the end portion 45*a* and end stop 45*b*** thereof. The lower end of the portion 54*b* is provided with a suction operating portion 54*d* of increased cross-sectional area into which a drive operating rod 54*e* is axially fitted. The rod 54*a* extends from and forms a continuation of the elongated shaft portion 54*b*. It will therefore be understood that the guide tube 45 positionally confines the switch-operating member 54 for axial rotation of the member 54 relative to the tube 45.

Figure 12:
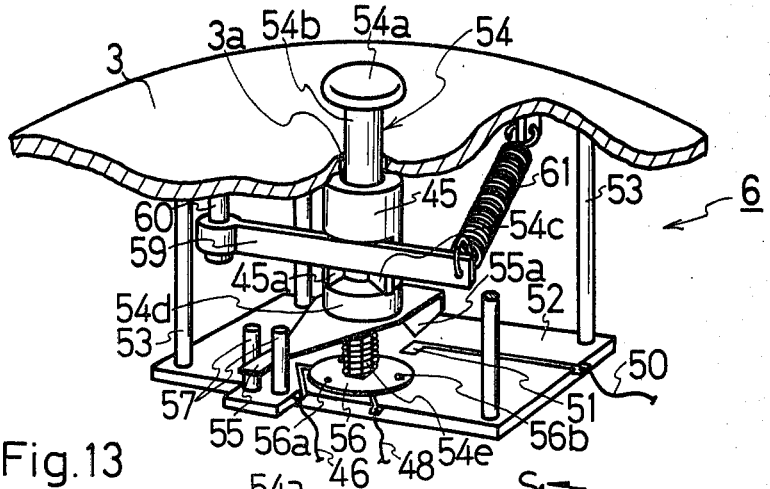
FIGS. 12 through 14 are perspective views of the operating switch of the inventive vacuum cleaner illustrated in various positions of use.
Figure 13:
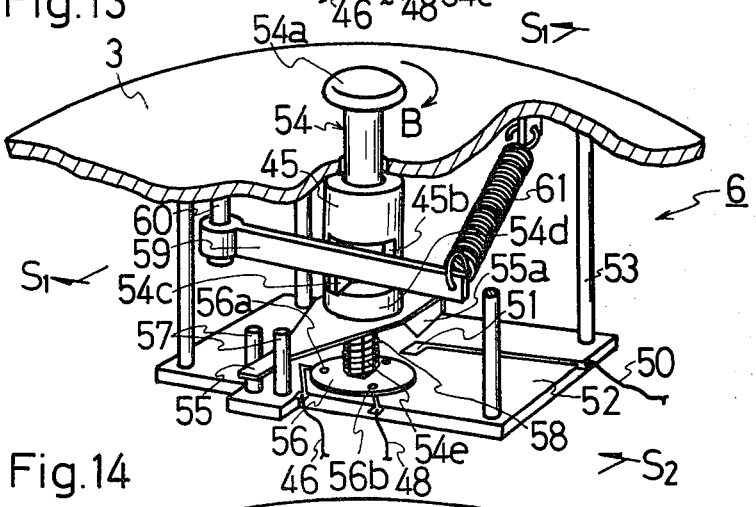
Figure 14:
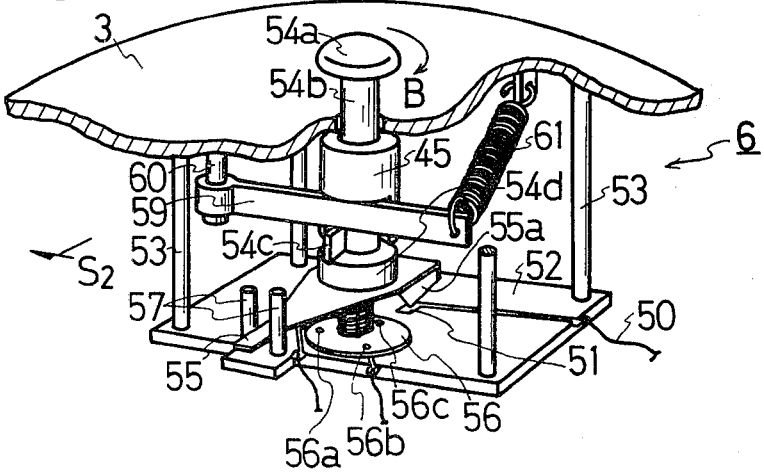

One end of a suction switch plate 55 formed of electrically conductive material is bent at substantially a right angle to the remainder to form a contact portion 55*a*. The drive operating rod 54*e* is journaled through a central portion of the suction switch plate 55 so that the end of the contact portion 55*a* is engageable with the printed suction contact 51 on the switch table 52. The end of the switch place 55 opposite its contact portion 55*a* is confined for vertical movement between a pair of guide posts 57 carried on the table 52, as best seen in FIGS. 12–14.

Figure 15:
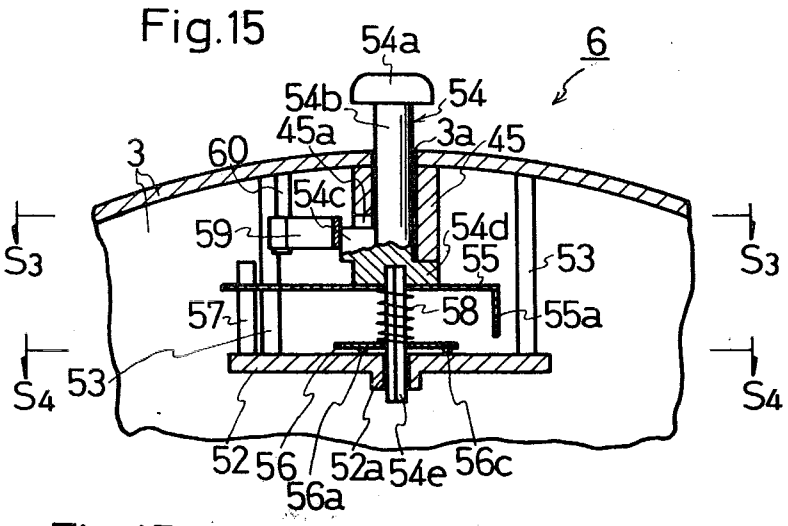
FIG. 15 is a side elevation, in longitudinal section, of the operating switch taken along the lines S1—S1 in FIG. 13.

The drive operating rod 54*e* is closely or tightly fitted for mutual rotation through the center of a substantially disc-shaped drive switch plate 56 formed of electrically conductive material and positioned below the suction switch plate 55. In order to insure mutual rotation of the plate 56 and the rod 45*e* the latter may be provided with the substantially square cross-sectional configuration shown. The drive switch plate 56 includes a pair of downwardly-directed integral projections 56*a*, 56*b* for contact with the printed common contact 47 and printed drive contact 49, respectively, on the switch table 52. Interposed between and maintaining a spaced-apart relation of the switch plates 55, 56 is an electrically conductive compression spring 58 spiraled circumferentially about the drive operating rod 54*e*. By reason of the spring 58, the suction switch plate 55 is held contiguously against the lower face of the suction operating portion 54*d* and the drive switch plate 56 is constantly urged downwardly against the upper surface of the switch table 52. The upwardly-directed spring force acting on the suction switch plate 55 causes its contact portion 55*a* to be normally lifted out of engagement with the printed suction contact 51 on the switch table 52 (FIG. 15). The compression spring 58 further serves to complete an electrical connection between the switch plates 55, 56. In order to stabilize the position of the drive plate 56 atop the switch table 52, an additional downwardly-directed projection 56*c* is provided on the plate 56.

A post 60 suspended from the dome 3 pivotally supports one end of the locking bar 59 so as to dispose the bar substantially perpendicular to the length of the switch operating member 54. The locking bar 59 is pivotally positioned at the elevation of the guide tube recess and is held against said recess by means of a tension spring 61 connected between the free end of the bar 59 and the dome 3. In this manner, the locking bar 59 is biased toward, and normally rests against, one end portion 45*a* of the recess as may be seen in FIG. 19.

When the button 54*a* of the switch member 54 is manually manipulated so as to axially rotate it in one direction, only the driving means 4 is operated. If the button 54*a* is then pressed down, electrical power is provided to the vacuum cleaning means 5 as well. Rotation of the switch member 54 in the opposite direction releases the same and terminates powered operation of both the driving means 4 and the vacuum cleaning means 5. In this embodiment, the operating rotational direction of the switch member 54 corresponds to the direction in which the cleaning device 1 is axially rotatable. This direction is designated by the reference arrow B in FIG. 5 and that convention will be retained throughout the remainder of the description.

The initial or "off" position of the switch operating member 54, in which neither the driving means 4 nor vacuum cleaning means 5 are powered, is seen in FIG. 12. As next illustrated in FIGS. 13 and 17, when the switch operating portion 54*a* is rotated in the B direction, the radial protrusion 54*c* is moved from end stop 45*b* of the guide tube recess to the end portion 45*a*. The protrusion 54*c*, and hence the whole of the integral switch member 54, is held in this new position by the locking bar 59 pressed against the protrusion 54*c* through the urging of spring 61. The correspondingly-rotated drive operating rod 54*e* causes the drive switch plate 56 to assume the rotated position best seen in FIG. 18 whereby the contact projections 56*a*, 56*b* thereof are moved into engaging contact with the printed contacts 47, 49 respectively on the switch table 52. The electrical connections so completed enable the delivery of battery power to the motor 13 for driving the vacuum cleaner wheels 7, 8.

In the absence of a radio control signal from the transmitter 34, the delivery of power to the motor 13 causes the cleaning device 1 to turn or revolve in the B direction with the switch operating member 54 delineating the axial center of rotation. The spring-biased locking bar 59 bears against the protrusion 54*c* to maintain the rotated position of the switch operating member 54 and powered operation of the motor 13. The cleaning device 1 accordingly axially rotates over a fixed ground surface position.

Figure 16:
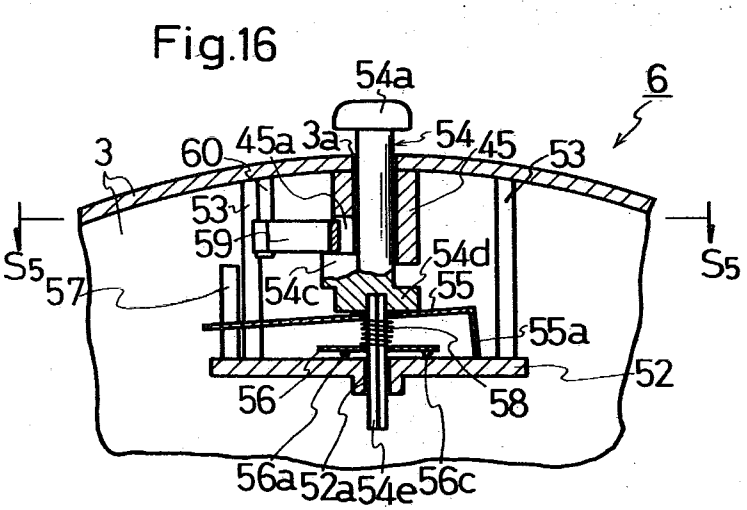
FIG. 16 is a side elevation, in longitudinal section, of the operating switch taken along the lines S2—S2 in FIG. 14.
Figure 19:
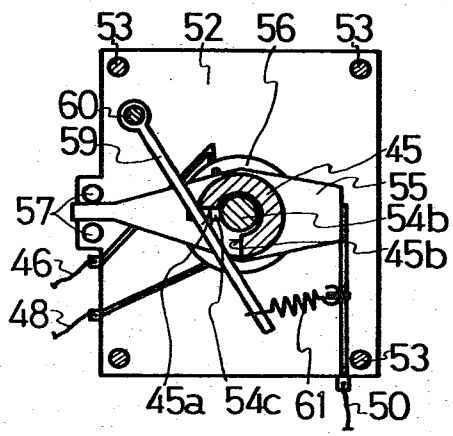
FIG. 19 is a plan view, in cross section, taken along the lines S5—S5 in FIG. 16.
Figure 18:
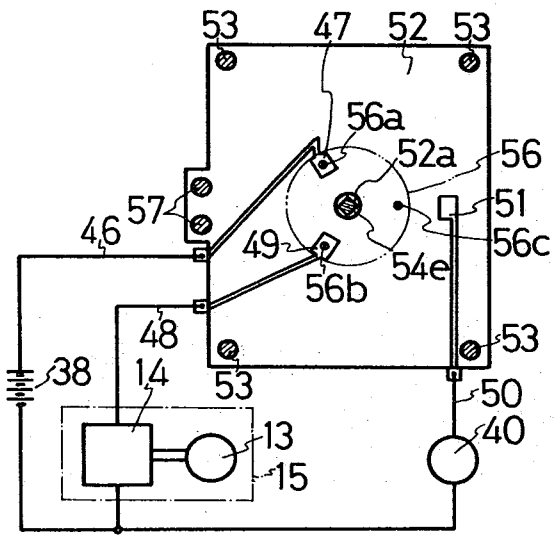
FIG. 18 is a plan view, in cross section, taken along the lines S4—S4 in FIG. 15.
Figure 17:
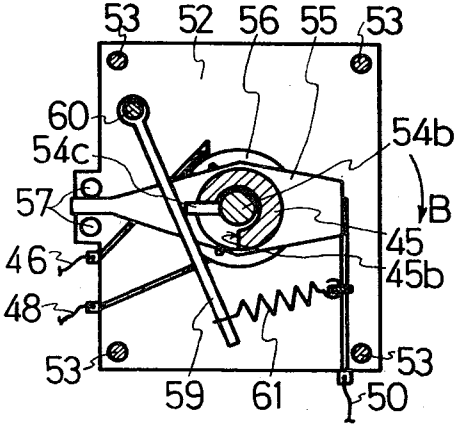
FIG. 17 is a plan view, in cross section, taken along the lines S3—S3 in FIG. 15.

Referring now to FIGS. 14 and 19, if the button 54*a* is depressed, the correspondingly depressed suction operating portion 54*d* of the switch member 54 carries the suction switch plate 55 before it and against the urging of spring 58. The plate 55 is thereby lowered to an extent sufficient to cause its contact portion 55*a* to electrically engage the printed suction contact 51 on the switch table 52 (FIG. 16). The electrical circuit path so completed between the switch plate 55 and printed contact 51 directs battery power to the suction motor 40 for driving the same and operating the vacuum cleaning means 5.

As the descending protrusion 54*c* clears the locking bar 59, the bias of the spring 61 causes the bar to move radially into the guide tube recess and to bear against the end portion 45*a* thereof. The top of the protrusion 54*c* engages the bottom of the radially-inwardly moving locking bar 59 whereby the shaft portion 54*b* is prevented from returning to its normally raised position when pressure on the button 54*a* is removed. As a consequence, momentarily depressing the switch operating member 54 locks the same in its lowered position and maintains a flow of battery power to the suction motor 40 for driving the vacuum cleaning means 5. It should be readily appreciated that depression of the button 54*a* is easily effected even while the cleaning device 1 is revolving about its central axis since it is positioned at the central axis of the device. The button 54*a* accordingly remains in a substantially fixed location irrespective of axially rotation motion of the cleaning device 1.

Disengagement of the switch member 54 from its locked position is easily effected by rotating the button 54*a* opposite to the B direction. When only the driving means 4 is operated (FIG. 13), this reverse rotation of the switch operating portion 54*a* causes the protrusion 54c to slide along the surface of the locking bar 59 from its initial engagement with the recess end portion 45a until the protrusion abuts the opposite end stop 45b. On the other hand, where both the driving means 4 and the vacuum means 5 are in operation (FIG. 14), the protrusion 54c slides along the lower edge of the locking bar 59 until it reaches and abuts the recess end stop 45b. At that point a clearance more easily seen in FIG. 19 permits the protrusion 54c to be released from its locked engagement under the bar 59. Such release enables the switch member 54 to be raised under the urgency of the spring 58 and thereby returned to its initial or deactivated position.

The upward return movement of the switch member 54 additionally results in disengagement of the contact portion 55a of the suction switch plate 55 from electrical contact with the printed contact 51 on the switch table 52. In either operating position of the switch member 54, of course, the so-called reverse or deactivating rotation of the member 54 causes corresponding rotation of the drive switch plate 56 effective to break the electrical connections between the projections 56a, 56b and the respective printed contacts 47, 49. The supply of battery power to the motor 13 is thereby discontinued so as to deactivate the driving means 4 and halt further movement of the cleaning device 1.

Thus, rotation of the switch member 54 in the direction opposite that designated B disconnects the supply of operating battery power to the driving means 4 and the vacuum cleaning means 5. Since the button 54a is positioned at the center of revolution of the cleaning device 1, and since the device 1 rotates on its central axis in the B-designated direction, reverse rotation of the switch member 54 is easily carried out by merely grasping the switch operating portion 54a as the device 1 axially revolves. In this manner the portion 54a is automatically turned, relative to the body of the cleaning device, opposite to the B direction. The resulting disconnection of operating power causes the cleaning device 1 to stop.

In use, the cleaning device 1 is readily operated by rotating the button 54a in the B or clockwise direction to activate the drive means 4. Concurrently, or subsequently, the button 54a is depressed to provide power to the vacuum cleaning means 5. The cleaner 1 is initially caused to revolve in a stationary position with respect to the underlying surface and about its central axis. The switch 35 of the transmitter 34 is thereafter depressed to cause the transmitter to send a radio control signal whereby the cleaning device 1 commences straight-line forward travel along the surface. So long as the transmitter switch 35 is depressed, this straight-line motion continues. Vacuum cleaning of the underlying surface, is, of course provided as the device 1 traverses its straight-line path.

Should the cleaning device 1 become stuck against a furniture leg or other obstacle, or should it be desired to change the direction of travel, the transmitter switch 35 is released so as to cause the cleaning device 1 to revolve on its axis and thereby change its orientation. Thus, by proper operation of the transmitter 34, the cleaning device 1 can be moved to any desired surface location—as for example to areas where cleaning by conventional means, such as below a table or bed, is normally difficult to carry out. Moreover, an unusually dusty location can be more thoroughly cleaned by allowing the cleaning device to there revolve on its axis, or hover, thereover, for an extended time. Should the cleaning device travel to an area in which radio control signals from the transmitter 34 cannot be received, the device 1 merely revolves on its axis, rather than continuing to move in a straight line, thereby preventing the same from traveling unpredictably astray.

When surface cleaning has been completed, the vacuum cleaning device 1 is permitted to revolve on its axis and the switch operating portion 54a is turned, as by simply grasping and holding the same relative to the revolving cleaner body, in the direction opposite that designated B. The driving means 4 and the vacuum cleaning means 5 are thereby simultaneously stopped.

In the disclosed embodiment of the self-propelled cleaning device, the provision of battery power to both the driving means 4 and the vacuum means 5 is carried out through the manually operated switch member 54. As a consequence, wireless remote-control of the driving means 4 requires only a single-channel radio transmission system of low cost and conventional design. However, those skilled in the art will recognize that the provision of a 2-channel remote transmission system would permit the vacuum cleaning means 5 to be controlled from a remote location as well. In such an embodiment, operation of the vacuum means 5 might be initiated only when the cleaning device 1 had reached a location requiring its use, thereby providing significant conservation of on-board battery power. As should also be clear, the switch member 54 would then be required to operate only the driving means 4, necessitating only axially rotative, and not vertical, mobility of the member 54.

Various other modifications of the disclosed embodiment are deemed to be within the teaching of the invention. Thus, it is intended that the motor 13 of the driving means 4 and the suction motor 40 of the vacuum cleaning means 5 might be consolidated into a single reversible motor. Such a modification would require that the intake fan 39 be of the sirocco-type or equivalent so that the same would continue to draw air into the cleaning device 1 irrespective of the rotative direction of the motor and hence of the fan 39.

It is further contemplated that the free-wheeling caster 11 could be replaced with a caster of sledge-shape or with a dust-brush (not shown) which projects below the suction case 42. Likewise, the receiving antenna 37 could be enclosed within the interior of the cleaner body.

A latitude of still additional information modification, change and substitution is intended in the foregoing disclosure. In some instances some features of the invention will be employed without a corresponding use of other features. Accordingly, it is appropriate that the appended claims be construed broadly and in a manner consistent with the spirit and scope of the invention herein.

What is claimed is:

1. A self-propelled device for vacuum cleaning of an underlying surface, comprising:

a cleaner body supported for movement on the underlying surface and including a base member;

driving means on said body for rotation of said body at a fixed surface location and for substantially straight-line movement of said body on and along the underlying surface;

means for wireless remote-controlled operation of said driving means to cause said driving means to selectively switch between stationary rotation and substantially straight-line movement of said cleaner body on receipt of a radio control signal;

vacuum means on said body for suction cleaning of the surface underlying said cleaner body, said vacuum means comprising a suction fan for drawing dirt into the cleaner body, a filter removably supported on said base member for collecting the dust drawn into the body, and an inlet port defined in said base and open in the direction of the underlying surface for dirt drawn from the surface to the interior of said cleaner body through the inlet port for collection in the filter;

battery means on said body for powering said driving means; and manual switch means on said cleaner body for connecting said battery means to and providing operating power for said driving means, said suction fan being powered by and connected to said battery means through said manual switch means.

2. A device according to claim 1 wherein said driving means comprises:

a pair of substantially parallel wheels rotatably mounted on said cleaner body;

an electric motor rotatable in normal and reverse directions; and power transmitting means for delivering the rotative power of said electric motor to said wheels for driving the same such that, in one of the rotational directions of the motor, each of said wheels is driven in an opposite rotational direction with respect to the other for rotation of said cleaner body at said location while, in the other direction of motor rotation, each said wheel is driven in the same rotational direction as the other for substantially straight-line movement of the body.

3. A device according to claim 2 wherein said power transmitting means includes clutch means for maintaining the same driven rotational direction of one of said wheels irrespective of the rotative direction of said motor, while the other of said wheels reverses its driven rotational direction as a result of a corresponding reversal in motor rotation.

4. A device according to claim 1 wherein said manual switch means is axially rotatable in a first direction for providing operating power to said driving means and in a second direction opposite to said first direction for terminating the supply of power thereto.

5. A device according to claims 1 or 4 wherein said manual switch means is located on the axis of rotation of said cleaner body such that a portion of said switch means projects through the upper portion of said body for manipulatable access by a user of said vacuum cleaning device.

6. A device according to claim 5 wherein said first direction corresponds to the direction of rotation of said cleaner body so as to facilitate manipulation of said switch means in said second direction for terminating the supply of power to the operating driving means, said manipulation being effected by grasping said projecting portion of the switch means as said cleaner body stationarily rotates in said first direction, thereby automatically causing rotation of said switch means in said second direction relative to said rotating cleaner body, said location of the projecting switch portion at the axis of stationary rotation of said cleaner body rendering the projecting portion easily accessible for said power supply-terminating manipulation.

7. A device according to claim 6 wherein said manual switch means is further arranged for movement along the axis of rotation of the cleaner body for connecting said battery means to, and providing operating power for, said vacuum means, such that the supply of battery power to said vacuum means is initiated by depressing said projecting switch portion with respect to said cleaner body and is terminated by a return of said portion to its initial projecting position.

8. A device according to claim 7 wherein said rotation of the switch means in said second direction for terminating the supply of operating power to said driving means is simultaneously effective to cause the return of said projecting switch portion from its depressed position so as to terminate the supply of operating power to said vacuum means.

9. A device according to claim 7 wherein said manual switch means is movable to operate said driving means without operating said vacuum means.

10. A self-propelled vacuum cleaner device for supported movement on and along an underlying surface, comprising:

a body;

drive means on said body and including a pair of substantially parallel wheels supporting said body on said surface and arranged for rotation with respect to said body, an electric motor rotatable in normal and reverse directions, a battery for powering said motor, an electronic contol circuit for causing reverse rotation of the motor in response to a radio control signal, and power transmitting means for transmitting the rotation of said motor to said wheels so as to rotatively drive the same such that one of said wheels is driven in either a forward or a reverse rotational direction depending upon the direction of motor rotation while the other said wheel is driven in said forward rotational direction irrespective of the direction of motor rotation, said wheels being thus driven in relatively opposite directions in the absence of a radio control signal whereby said body is caused to rotate at a substantially stationary location on the underlying surface, and said wheels being driven in the same direction in response to a radio control signal for substantially straight-line movement of said body along the surface;

vacuum cleaning means on said body and including a suction port to serve as an inlet for dust and open in the direction of the underlying surface, a suction fan, a suction motor for driving said fan to draw dust from the surface into said body through said port, and a filter for collecting dust drawn into said body by the action of said motor-driven suction fan; and manual switch means rotatable in a first direction for operating said electric motor, movable in a second direction for operating said suction motor, and rotatable in a third direction opposite said first direction for disengaging said switch means to terminate operation of said electric and suction motors, said switch means being located on said body at the center of stationary rotation thereof for facilitated manual user access to said switch means during said substantially stationary rotation of the body.

* * * * *